US009724744B2

(12) United States Patent
Kim et al.

(10) Patent No.: US 9,724,744 B2
(45) Date of Patent: Aug. 8, 2017

(54) APPARATUS FOR MANUFACTURING LONG-NECK FLANGE BY APPLYING ROLLER SPINNING AND METHOD THEREFOR

(71) Applicant: Jaesoo Kim, Saha-gu (KR)

(72) Inventors: Jaesoo Kim, Saha-gu (KR); Jongrae Cho, Geumjeong-gu (KR); Jinyoung Choi, Gimhae-si (KR)

(73) Assignee: Jaesoo Kim, Saha-gu (KR)

( * ) Notice: Subject to any disclaimer, the term of this patent is extended or adjusted under 35 U.S.C. 154(b) by 99 days.

(21) Appl. No.: 14/759,660

(22) PCT Filed: Nov. 7, 2013

(86) PCT No.: PCT/KR2013/010043

§ 371 (c)(1),
(2) Date: Jul. 8, 2015

(87) PCT Pub. No.: WO2014/109470

PCT Pub. Date: Jul. 17, 2014

(65) Prior Publication Data

US 2015/0343511 A1 Dec. 3, 2015

(30) Foreign Application Priority Data

Jan. 8, 2013 (KR) ..... 10-2013-0002153

(51) Int. Cl.
*B21D 22/16* (2006.01)
*B21D 19/04* (2006.01)
*B21D 22/18* (2006.01)

(52) U.S. Cl.
CPC ..... *B21D 19/046* (2013.01); *B21D 22/16* (2013.01); *B21D 22/18* (2013.01)

(58) Field of Classification Search
CPC ..... B21D 19/046; B21D 22/16; B21D 22/18; B21K 21/12
See application file for complete search history.

(56) References Cited

U.S. PATENT DOCUMENTS 2,310,158 A * 2/1943 Austin ..... B21D 19/046 219/154
2004/0089043 A1* 5/2004 Meinig ..... B21D 19/046 72/86

FOREIGN PATENT DOCUMENTS

JP 61-279315 12/1986
JP 08-164433 6/1996
(Continued)

OTHER PUBLICATIONS

International Search Report Dated Feb. 12, 2014 From the Korean Intellectual Property Office Re. Application No. PCT/KR2013/010043 and its Translation Into English.

*Primary Examiner* — Debra Sullivan

(57) ABSTRACT

Disclosed is an apparatus for manufacturing a long-neck flange comprising: a pipe support bar for supporting the inside of a pipe, the pipe support bar being rotatable; a rotatable pressurizing device connected to the pipe support bar for simultaneously rotating, pressurizing, and conveying the pipe with one end fixed thereto; a face roller for contacting a cross section of the pipe support bar to form a flange surface; a curvature roller positioned at the outside of the pipe for giving a curvature to the flange part; and a circumferential roller positioned at the outside of the pipe in the circumferential direction so as to form the width of the flange part.

3 Claims, 9 Drawing Sheets

(56) References Cited

FOREIGN PATENT DOCUMENTS

| | | |
|---|---|---|
| JP | 10-156450 | 6/1998 |
| JP | 2000-005839 | 1/2000 |
| WO | WO 2014/109470 | 7/2014 |

* cited by examiner

APPARATUS FOR MANUFACTURING LONG-NECK FLANGE BY APPLYING ROLLER SPINNING AND METHOD THEREFOR

RELATED APPLICATIONS

This application is a National Phase of PCT Patent Application No. PCT/KR2013/010043 having International filing date of Nov. 7, 2013, which claims the benefit of priority of Korean Patent Application No. 10-2013-0002153 filed on Jan. 8, 2013. The contents of the above applications are all incorporated by reference as if fully set forth herein in their entirety.

TECHNICAL FIELD

The present invention relates to an apparatus for manufacturing a long-neck flange and a method therefor, and more particularly, to an apparatus for manufacturing a long-neck flange which is capable of simply and efficiently manufacturing a long-neck flange in which a flange part is integrally formed and a method therefor.

BACKGROUND ART

In general, a long-neck flange is used to closely connect two pipes to each other, and there is an increasing need for the long-neck flange.

The long-neck flange is also called a lap joint flange or a stub end, and the structure and manufacturing method thereof are various.

As shown in FIG. 1, in a method of manufacturing a long-neck flange according to the related art, a long-neck flange includes a pipe part 1; and a flange part 2 coupled to an end of the pipe part 1, and is manufactured by forming the flange part 2 through the formation of a flat plate in a ring shape and then coupling the formed flange part 2 to the pipe part 1 through welding.

However, in the method of manufacturing a long-neck flange, since it is necessary to perform a process of coupling the flange part 2 to the pipe part 1 as well as a process of forming the flange part 2 with a predetermined size and shape, there are problems in that a manufacturing process is complicated and manufacturing costs are high. Since the pipe part 1 and the flange part 2 are weld using weld beads 4*a* and 4*b*, it is difficult to stably maintain the coupling state thereof for a long term, the strength thereof is weak due to thermal stress locally generated in the welded part, and the welded part is inconveniently processed again in a desired shape after the welding is performed.

SUMMARY OF THE INVENTION

An object of the present invention is to provide a manufacturing apparatus capable of efficiently manufacturing a long-neck flange by simplifying a manufacturing method and process and producing a long-neck flange with excellent mechanical characteristics in quantity, and a method therefor.

Technical Solution

There is provided an apparatus for manufacturing a long-neck flange by applying roller spinning. The manufacturing apparatus includes: a pipe support bar that comes in close contact with an inner surface of a pipe (10) to support a pipe shape;

a rotatable pressurizing device that is integrally coupled to the pipe, and pressurizes and conveys the pipe to one side while fixing an end of the pipe;

conveyance means for conveying the rotatable pressurizing device;

rotation means for rotating the rotatable pressurizing device;

a face roller that comes in contact with the end of the pipe, and guides the end of the pipe such that the end of the pipe is bent with an angle of 90 degrees while preventing the pipe from moving in a straight line;

a curvature roller that comes in contact with a circumferential surface of the end of the pipe, and maintains a predetermined distance from the face roller, a shape of the curvature roller including an inclined straight part having an angle of 45 degrees with respect to a center of the curvature roller and a curvature part formed as a predetermined curvature surface along the center of the curvature roller; and a circumferential roller that moves while coming in contact with a circumferential surface of a flange part formed at the end of the pipe.

A procedure of manufacturing a long-neck flange of the present invention is as follows.

The manufacturing procedure includes: a step (S100) of attaching one end of a pipe which is a base material for forming a long-neck flange to a rotatable pressurizing device;

a step (S200) of disposing a face roller at the other end of the pipe so as to come in contact with each other, bringing a curvature roller into contact with a circumferential surface of the other end of the pipe, and disposing a circumferential roller on the circumferential surface of the other end of the pipe so as to come in contact with each other while maintaining a predetermined distance between the face roller and the curvature roller;

a step (S300) of moving the pipe in a straight line by a rotatable pressurizing device, and rotating and moving the circumferential roller while coming in contact with a circumferential surface of the flange by forming a flange part of the pipe, and forming the flange part at the end of the pipe so as to allow the flange part to have a curvature; and a step (S400) of increasing a width of the flange by continuously pressurizing the pipe.

Effect of the Invention

According to the present invention, the apparatus for manufacturing a long-neck flange can improve manufacturability and economical efficiency by innovatively improving and simplifying a manufacturing process, and thus, it is possible to conveniently and rapidly manufacture the long-neck flange.

It is possible to reduce time and cost required to manufacture the long-neck flange, and it is possible to effectively prevent a phenomenon in which mechanical characteristics of the long-neck flange are degraded by thermal stress.

Since it is possible to continuously manufacture the long-neck flange through a series of processes, it is possible to produce the long-neck flange in quantity by applying and introducing an automation system, and it is possible to easily adjust and increase the thickness and width of the flange part of the long-neck flange.

DESCRIPTION OF SPECIFIC EMBODIMENTS OF THE INVENTION

Figure 1:
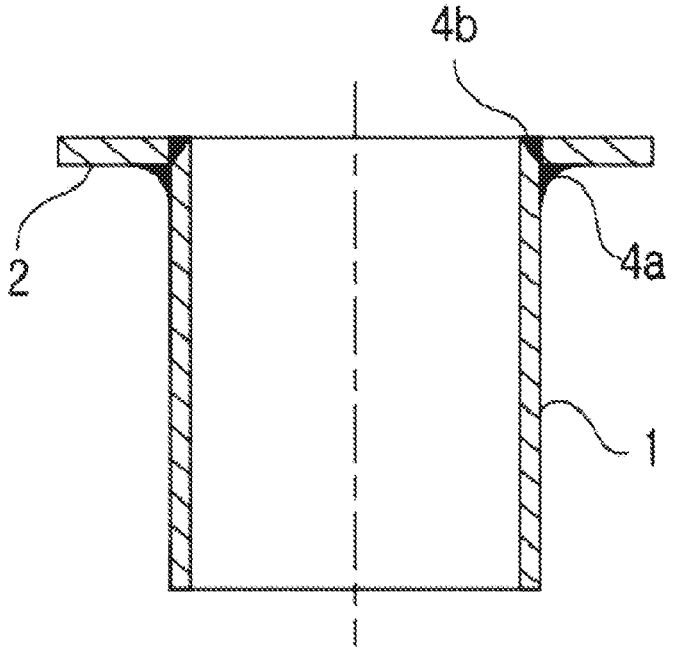
FIG. 1 (PRIOR ART)
FIG. 1 is a cross-sectional view of a long-neck flange according to the related art.

A best mode of the present invention is as follows.

An apparatus for manufacturing a long-neck flange according to the present invention includes: a pipe support bar (30) that comes in close contact with an inner surface of a pipe (10) to support a pipe shape; a rotatable pressurizing device (20) that is integrally coupled to the pipe, and pressurizes and conveys the pipe to one side while fixing an end of the pipe; conveyance means for conveying the rotatable pressurizing device; a face roller (40) that comes in contact with the end of the pipe, and guides the end of the pipe such that the end of the pipe is bent with an angle of 90 degrees while preventing the pipe from moving in a straight line; a curvature roller (60) that comes in contact with a circumferential surface of the end of the pipe, and maintains a predetermined distance (t) from the face roller, a shape of the curvature roller including an inclined straight part (62) having an angle of 45 degrees with respect to a center of the curvature roller and a curvature part (64) formed as a predetermined curvature surface along the center of the curvature roller; and a circumferential roller (50) that moves while coming in contact with a circumferential surface (122) of a flange part (120) formed at the end of the pipe.

A method for manufacturing a long-neck flange includes: a step (S100) of attaching one end of a pipe which is a base material for forming a long-neck flange to a rotatable pressurizing device (20); a step (S200) of disposing a face roller (40) at the other end of the pipe so as to come in contact with each other, bringing a curvature roller (60) into contact with a circumferential surface of the other end of the pipe, and disposing a circumferential roller (50) on the circumferential surface of the other end of the pipe so as to come in contact with each other while maintaining a predetermined distance (t) between the face roller and the curvature roller; a step (S300) of moving the pipe in a straight line by a rotatable pressurizing device, and rotating and moving the circumferential roller (50) while coming in contact with a circumferential surface (122) of the flange by forming a flange part of the pipe, and forming the flange part at the end of the pipe so as to allow the flange part to have a curvature; and a step (S400) of increasing a width of the flange by continuously pressurizing the pipe.

MODE FOR CARRYING OUT THE INVENTION

Hereinafter, preferred embodiments of the present invention will be described with reference to the drawings.

It should be noted that the scope of the present invention is not limited by the following embodiments, and all inventions equivalent to the claims are included in the right scope of the present invention.

Figure 6:
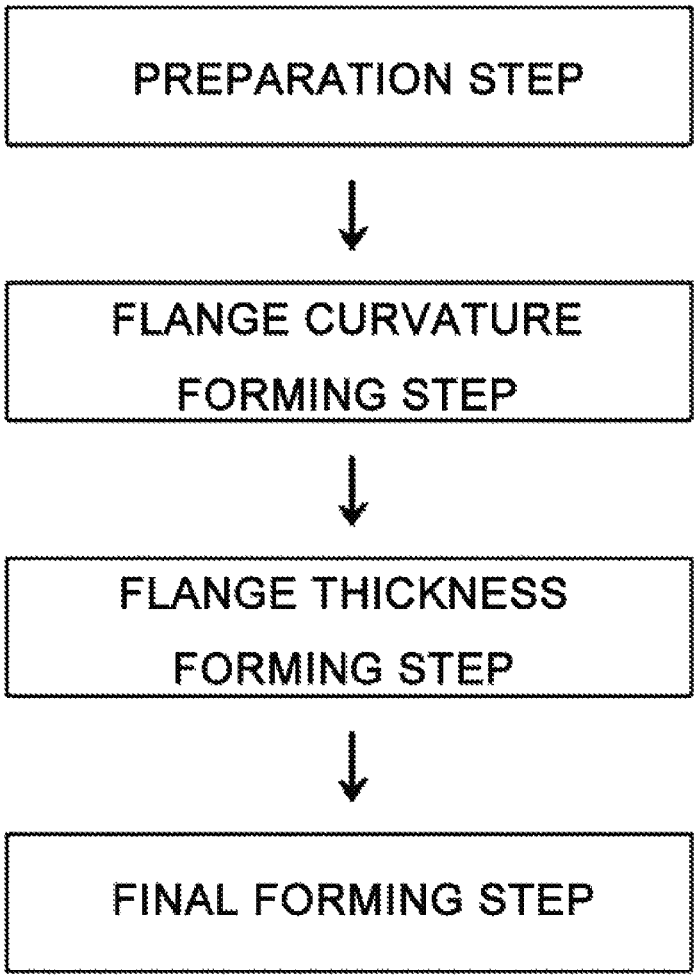
FIG. 6 is a flowchart for manufacturing the long-neck flange.
Figure 7:
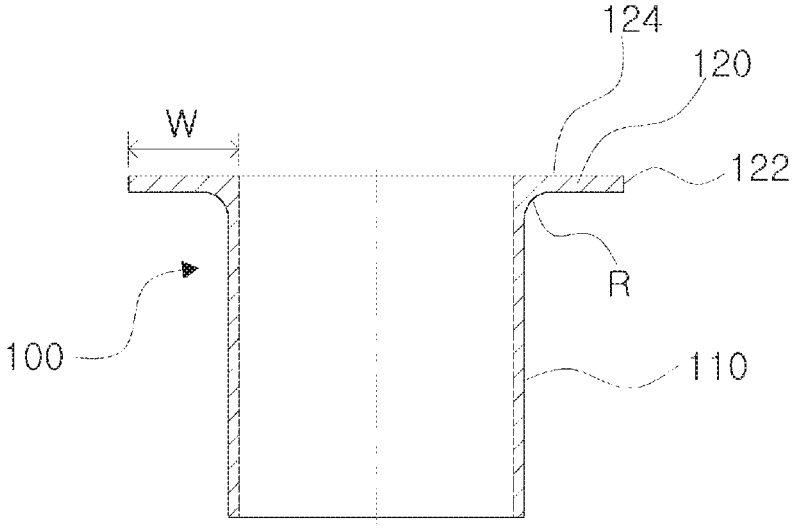
FIGS. 7 and 8 are cross-sectional views and perspective view of the completed long-neck flange.
Figure 8:
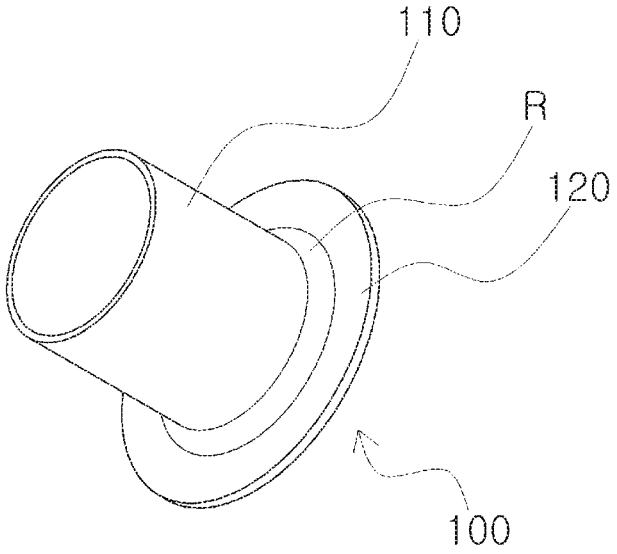
Figure 9:
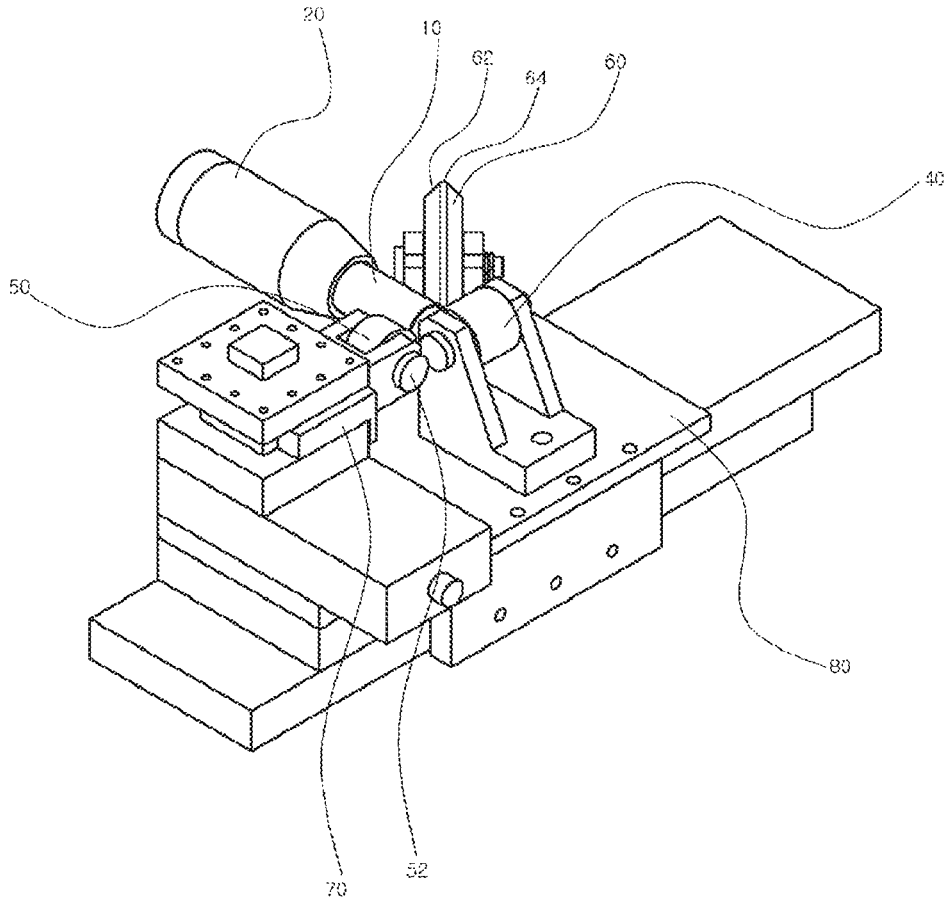
FIG. 9 is a perspective view of the apparatus shown in FIGS. 2, 3, 4 and 5.
Figure 10:
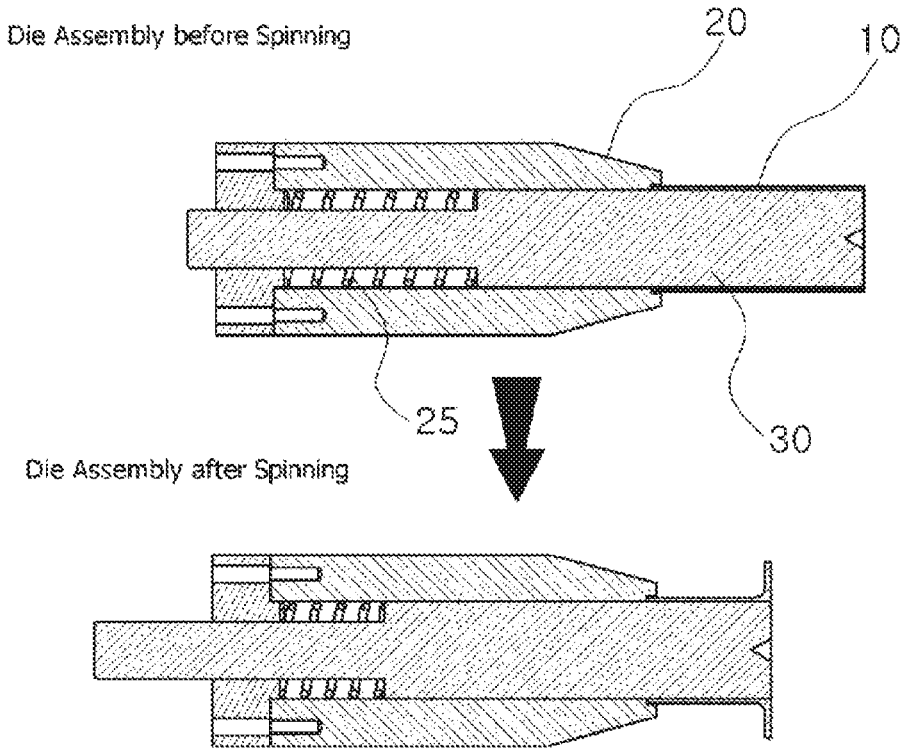
FIG. 10 is a cross-sectional view showing an internal structure of a rotatable pressurizing device and a pipe support bar and the deformation of a pipe.
Figure 11:
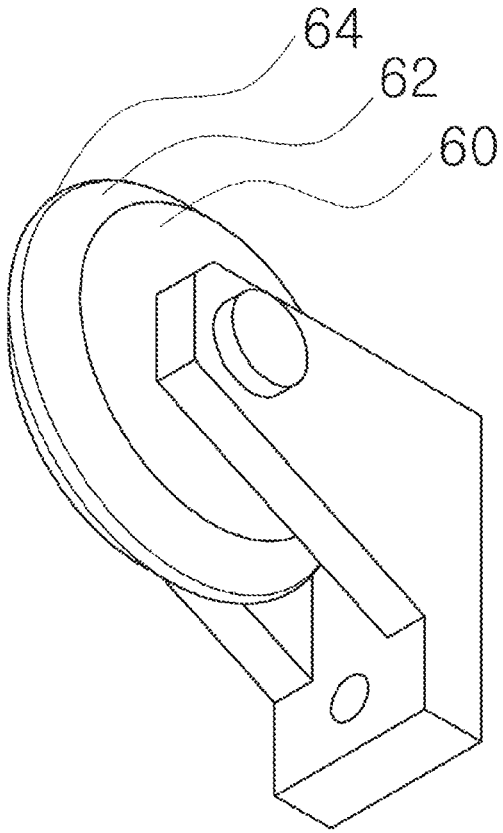
FIG. 11 is a perspective view of a curvature roller.

FIG. 1 is a cross-sectional view showing a long-neck flange according to the related art, FIGS. 2, 3, 4 and 5 are plan views of an apparatus for manufacturing a long-neck flange, and cross-sectional views showing manufacturing processes for each step, FIG. 6 is a flowchart showing processes of manufacturing the long-neck flange, FIGS. 7 and 8 are a cross-sectional view and a perspective view of the completed long-neck flange, FIG. 9 is a perspective view of the apparatus shown in FIGS. 2, 3, 4 and 5, FIG. 10 is a cross-sectional view showing the internal structure of a rotatable pressurizing device and a pipe support bar and the deformation of a pipe, and FIG. 11 is a perspective view of a curvature roller.

For easier understanding, a shape of a long-neck flange 100 completed by the apparatus of the present invention is shown in FIGS. 7 and 8. FIG. 8 corresponds to a perspective view when FIG. 7 turns upside down. The completed long-neck flange is manufactured by a plastic forming method of forming an end of a pipe in a flange shape by pressurizing a straight pipe in one direction, and the flange part and the pipe part are integrally formed. In FIG. 7, W denotes a width of the flange part, reference numeral 124 denotes a gasket face, and reference numeral 122 denotes a circumferential surface of the flange part.

As described above, the long-neck flange of the present invention does not need a welding process which has been required in the related art. That is, the process of separately manufacturing the flange part 2 and the pipe part 1 to couple the welded parts 4*a* and 4*b* is not needed, and thus, it is possible to remarkably reduce an operation time and costs in a coupling process.

Figure 2:
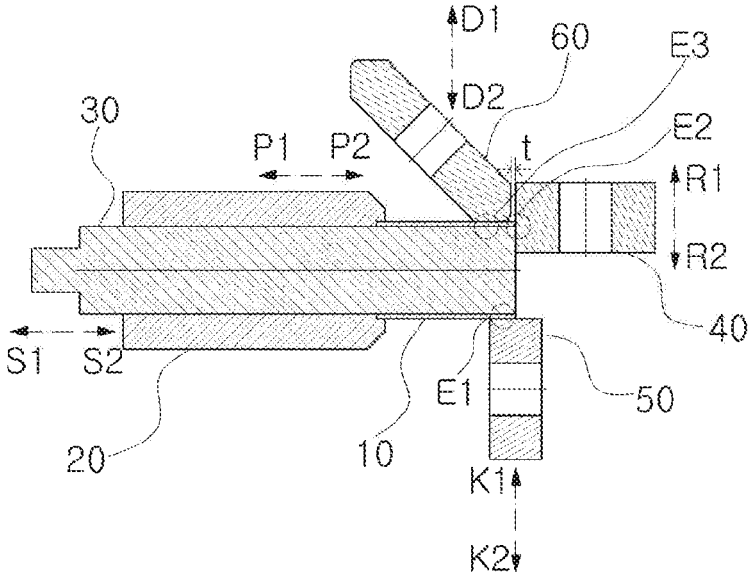
FIGS. 2, 3, 4 and 5 are plan views of an apparatus for manufacturing a long-neck flange and cross-sectional views showing processes of manufacturing the long-neck flange for each step.

FIG. 2 shows a state where devices for manufacturing the long-neck flange are prepared, and three rollers 40, 50 and 60 are arranged around a pipe 10 which is a processing target object.

A circumferential roller 50 comes in contact with an outer circumferential surface of the end of the pipe in parallel (see E1), and a face roller 40 comes in contact with a thickness surface of the end of the pipe (see E2).

An inclined straight part of a curvature roller 60 comes in contact with the outer circumferential surface of the end of the pipe in parallel, as shown by E3.

A pipe support bar 30 supports the pipe by coming in close contact with the pipe within the pipe such that the shape of the pipe can be maintained during the formation of the pipe.

The curvature roller 60 is disposed so as to have an axis with an angle of 45 degrees with respect to a longitudinal direction of the pipe, the face roller 40 is disposed so as to have an axis perpendicular to the longitudinal direction of the pipe, and the circumferential roller 50 is disposed so as to have an axis parallel to the longitudinal direction of the pipe.

Figure 12:
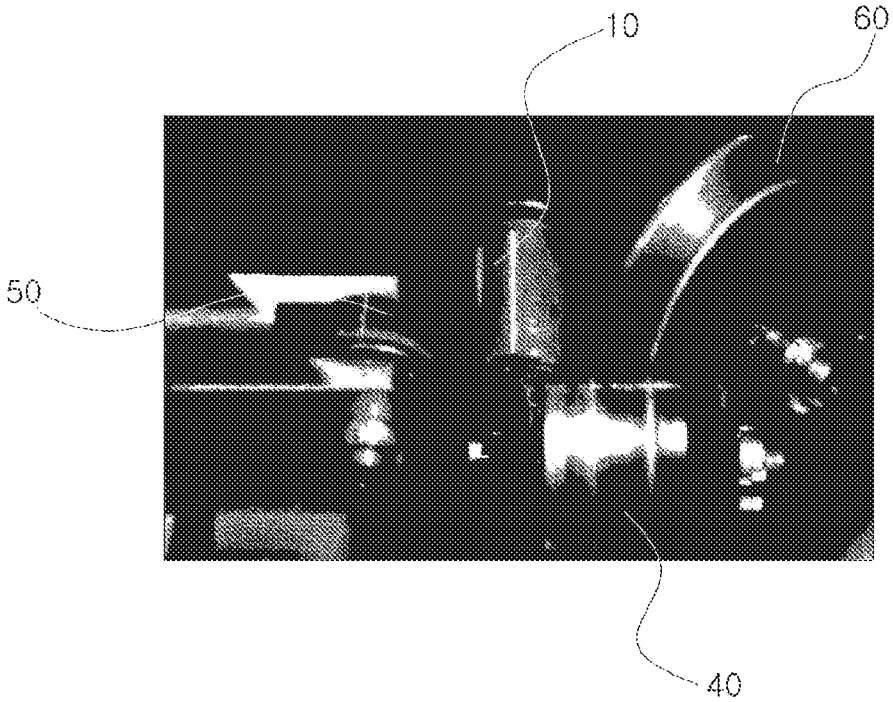
FIG. 12 is a picture obtained by photographing a manufacturing scene of the long-neck flange.

An actual appearance of the manufacturing apparatus can also be checked through three-dimensional views and photographs of FIGS. 9 and 12.

Figure 3:
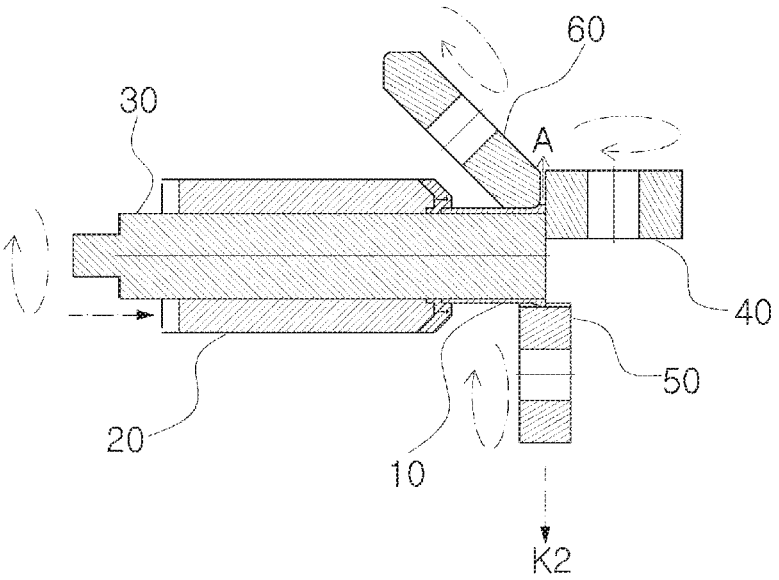

In a preparation state shown in FIG. 2, the pipe 10 integrally moves along with the operation of the rotatable pressurizing device while one end thereof is coupled to an end of the rotatable pressurizing device, as shown in FIG. 3.

The three rollers can rotate around their axes, and are provided so as to move in a straight line. The curvature roller 60 can move in forward, backward, leftward and rightward directions D1, D2, P1 and P2, and the face roller 40 can perform translation motion in R1 and R2 directions. The circumferential roller 50 can move in K1 and K2 directions. Means for moving the rollers are a well-known art used in a typical conveyance device, and thus, the detailed description thereof will be omitted.

In FIG. 3, the body of the pipe 10 and the circumferential roller 50 perform straight-line motion. In FIG. 3, it can be seen that the end of the pipe slightly moves up in an A direction, and this shows an initial state in which a shape of a flange part 120 is slightly formed. In this case, the face roller 40 and the curvature roller 60 do not perform the straight-line motion, and only rotate in their original positions.

However, the circumferential roller 50 moves in a K2 direction from the position of FIG. 2 as the flange part is formed. By moving the circumferential roller while coming in contact with a circumferential surface 122 of the flange part during the movement, it is possible to form the flange part while maintaining the thickness of the flange. The movement speed of means for moving the circumferential roller may be determined by predetermined control means (not shown).

Figure 4:
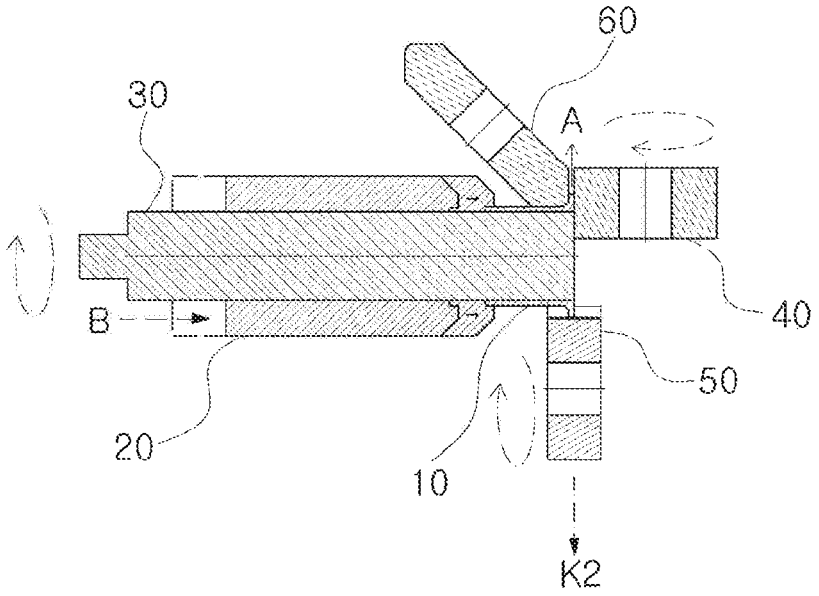
Figure 5:
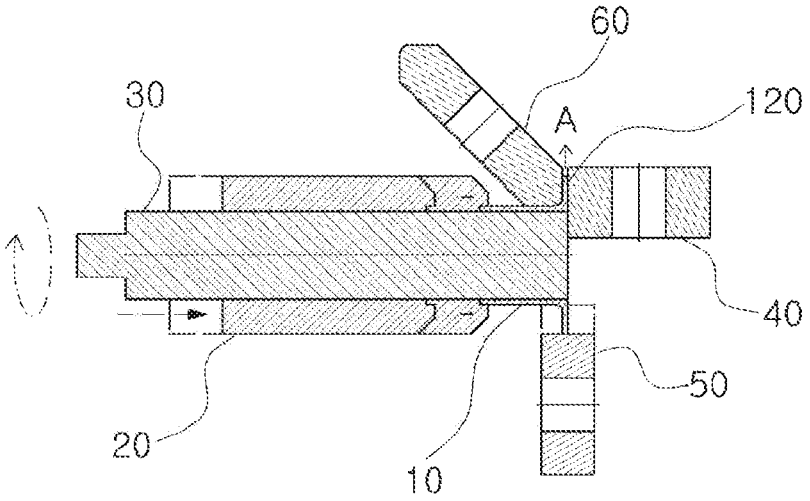

When comparing FIG. 3 with FIG. 4, it can be seen that the body of the pipe 10 further moves rightward and the formation of the flange further progresses in the A direction.

The curvature-formed shape of the end of the pipe is closely related to the shape of the circumferential roller 50. In FIG. 11, the shape of the circumferential roller is enlargedly illustrated, and a curvature part 64 of the central end corresponds to a part where the curvature part (R in FIGS. 7 and 8) of the flange is formed.

As can be seen from FIG. 4, the inclined straight part 62 of FIG. 11 is a part that comes in contact with a lower surface of the flange formed at the circumferential surface of the pipe, and the inclined straight part is inclined with an angle of 45 degrees.

A part indicated by t in FIG. 2 corresponds to a distance between the inclined straight part 62 (FIG. 11) which is an inclined surface of the end of the curvature roller 50 and a surface of the face roller 40. The distance t corresponds to a passage where the end of the pipe is moved in the A direction by being pressed as shown in FIG. 3, and corresponds to the thickness of the flange part 120. That is, the thickness of the flange part can be adjusted by adjusting the distance t, and it is possible to manufacture flange parts having various thicknesses according to the present invention.

The entire process of the present invention is briefly described again. The pipe 10 is pressurized in one direction, and is moved in the straight line. Among the three rollers surrounding the end of the pipe, the face roller 40 prevents the end of the pipe from moving in the straight line, and allows for the plastic deformation of the end of the pipe in the direction (A direction in FIG. 3) perpendicular to the longitudinal direction of the pipe.

Means for pressing the pipe toward the face roller 40 is the rotatable pressurizing device 20, and a driving source for pressing the rotatable pressurizing device may be any means such as an electric motor or hydraulic pressure.

Meanwhile, FIG. 10 shows an internal cross-sectional shape of the rotatable pressurizing device 20 for moving the pipe. A spring 25 is interposed in a space between the body of the pipe support bar 30 for supporting the inside of the pipe and the pressurizing device, and the spring is compressed during the forming process.

In FIG. 6, the manufacturing process described above is briefly described. The curvature part (FIG. 3) of the flange is firstly formed through the preparing step described in FIG. 2. Subsequently, the step of forming the flange so as to have a predetermined thickness t is performed as shown in FIG. 4.

Ultimately, since the completed flange part 120 needs to prevent the pressure and fluid from leaking by coming in contact with the gasket, a process of partially cutting the flange part may be performed on the flange part. Since the procedure of FIG. 6 is performed as a substantially continued process, there is a great advantage in that unnecessary processes such as a welding process are omitted, unlike the related art.

INDUSTRIAL APPLICABILITY

By using the apparatus for manufacturing a long-neck flange of the present invention, since a long-neck flange can be continuously manufactured by an automation apparatus, the apparatus of the present invention has high industrial applicability.

What is claimed is:

1. An apparatus for manufacturing a long-neck flange by applying roller spinning, the apparatus comprising:

a pipe support bar (30) that comes in close contact with an inner surface of a pipe (10) to support a pipe shape;

a rotatable pressurizing device (20) that is integrally coupled to the pipe, and pressurizes and conveys the pipe to one side while fixing an end of the pipe;

conveyance means for conveying the rotatable pressurizing device;

a face roller (40) that comes in contact with the end of the pipe, and guides the end of the pipe such that the end of the pipe is bent with an angle of 90 degrees while preventing the pipe from moving in a straight line;

a curvature roller (60) that comes in contact with a circumferential surface of the end of the pipe, and maintains a predetermined distance (t) from the face roller, a shape of the curvature roller including an inclined straight part (62) having an angle of 45 degrees with respect to a center of the curvature roller and a curvature part (64) formed as a predetermined curvature surface along the center of the curvature roller;

a circumferential roller (50) that moves while coming in contact with a circumferential surface (122) of a flange part (120) formed at the end of the pipe; and conveyance means for conveying the circumferential roller (50) in a direction perpendicular to a longitudinal direction of the pipe;

wherein the circumferential roller is conveyed while coming in contact with the circumferential surface (122) of the flange part.

2. The apparatus for manufacturing a long-neck flange by applying roller spinning according to claim 1, further comprising:

conveyance means for conveying the curvature roller (60) in forward, backward, leftward and rightward directions, wherein a distance between the face roller (40) and the inclined straight part (62) of the curvature roller is able to be adjusted.

3. A method for manufacturing a long-neck flange by using an apparatus for manufacturing a long-neck flange, the method comprising:

a step (S100) of attaching one end of a pipe which is a base material for forming a long-neck flange to a rotatable pressurizing device (20);

a step (S200) of disposing a face roller (40) at the other end of the pipe so as to come in contact with each other, bringing a curvature roller (60) into contact with a circumferential surface of the other end of the pipe, and disposing a circumferential roller (50) on the circumferential surface of the other end of the pipe so as to come in contact with each other while maintaining a predetermined distance (t) between the face roller and the curvature roller;

a step (S300) of moving the pipe in a straight line by a rotatable pressurizing device, and rotating and moving the circumferential roller (50) while coming in contact with a circumferential surface (122) of the flange by forming a flange part of the pipe, and forming the flange part at the end of the pipe so as to allow the flange part to have a curvature; and a step (S400) of increasing a width of the flange by continuously pressurizing the pipe, wherein an inclined straight part (62) having an angle of 45 degrees with respect to a center of the curvature roller, and a curvature part (64) formed as a predetermined curved surface along the center of the curvature roller are formed at the curvature roller (60), the flange part (120) is formed at the curvature roller so as to be perpendicular to a longitudinal direction of the pipe, and a flange curved surface having a shape (64) corresponding to the curvature part (64) is formed at the curvature roller.

* * * * *